United States Patent [19]

Graupner et al.

[11] 4,221,565

[45] Sep. 9, 1980

[54] PROCESS AND APPARATUS FOR MACHINE WASHING AND CLEANING WITH LOW-PHOSPHATE OR PHOSPHATE-FREE WASHING SOLUTIONS

[75] Inventors: Werner Graupner, Dormagen; Heinz Oberlack, Meerbusch; Hermann-Josef Welling, Viersen, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 973,792

[22] Filed: Dec. 28, 1978

[51] Int. Cl.[2] ..... B08B 3/00

[52] U.S. Cl. ..... 8/137; 8/141; 68/13 A; 252/179

[58] Field of Search ..... 8/137, 141; 252/179

[56] References Cited

U.S. PATENT DOCUMENTS

| | | | |
|---|---|---|---|
| 4,120,653 | 10/1978 | Smolka | 8/137 |
| 4,121,903 | 10/1978 | Smolka | 8/137 |
| 4,144,093 | 3/1979 | Reinwald | 8/137 |

FOREIGN PATENT DOCUMENTS

| | | |
|---|---|---|
| 2543946 | 4/1976 | Fed. Rep. of Germany . |
| 1521910 | 8/1978 | Fed. Rep. of Germany . |

*Primary Examiner*—Melvyn I. Marquis

*Attorney, Agent, or Firm*—Hammond & Littell, Weissenberger and Muserlian

[57] ABSTRACT

A process for the machine washing and cleaning of solid materials, in particular textiles, using low phosphate or phosphate-free detergents, in which the wash liquor, which contains at least 0.05 gm/l of a water-soluble calcium-binding sequestrant and customary surface-active compounds, is continuously or intermittently circulated through a cation-exchanging, water-insoluble, bound-water containing aluminosilicate having a calcium binding power of at least 50 mg CaO/gm corresponding to the following formula:

$$(Cat_{2/n}O)_x.Al_2O_3.(SiO_2)_y$$

in which Cat represents a cation of valence n which is exchangeable with calcium, x represents a number from 0.7 to 1.5 and y represents a number of from 0.8 to 6, and in which the aluminosilicate has a particle size of from 0.05 to 1 mm and is situated in a swirl chamber connected to the circulation of the detergent liquor, in which chamber the direction of flow is opposite to gravity and the flow velocity of the liquid is lower at least at the outflow than the rate at which the aluminosilicate particles sink.

There is also provided an apparatus for carrying out this process.

8 Claims, 6 Drawing Figures

PROCESS AND APPARATUS FOR MACHINE WASHING AND CLEANING WITH LOW-PHOSPHATE OR PHOSPHATE-FREE WASHING SOLUTIONS

BACKGROUND OF THE INVENTION

This invention relates to a process for the machine washing and cleaning of solid materials, in particular textiles, and to an apparatus for carrying out this process.

A washing and cleaning process has been disclosed in German Published Application (Auslegeschrift) No. 2,543,946, corresponding to United States patent application Ser. No. 618,461, filed Oct. 1, 1975, now abandoned in favor of its continuation Ser. No. 872,561, filed Jan. 26, 1978, in which the wash liquor, which can contain a water-soluble sequestrant and customary surface-active compounds, is continuously or intermittently removed during the cleaning process from the container in which the cleaning process takes place, and is passed through a filter bed which is charged with a water-insoluble cation-exchanging, bound-water containing alumino silicate having a calcium binding power of at least 50 mg CaO/gm, for example, one corresponding to the following formula:

$$(Na_2O_x.Al_2O_3.(SiO_2)_y$$

in which:

x=0.7 to 1.5, and y=1.3 to 3.3.

After passing through the filter bed, which must be designed to retain the aluminosilicate, the wash liquor returns to the cleaning vessel or substrate. The water-soluble sequestrant contained in the wash liquor is regenerated by the contact with the cation-exchanger. The cleaning effect which can thereby be achieved may surpass that of a conventional cleaning or washing process in which the aluminosilicate is suspended in the detergent liquor and is in direct contact with the substrate to be cleaned. However, problems may arise due to blockage of the filter, which is particularly likely to occur if very finely divided and highly reactive aluminosilicate is used or if large quantities of dirt and lint from textiles, or food residues in the case of dishwashing, are present as an added load on the filter. Although suitable design of the filter or the provision of devices for reversing the direction of flow to free the blocked filter surface, can provide substantial improvements, the problem remains.

OBJECTS OF THE INVENTION

An object of the present invention is the development of a process and apparatus to avoid the requirement for filtration of the solid aluminosilicate particles from the circulating wash liquor.

Another object of the present invention is the development of an improvement in a cyclic method for the machine washing of soiled solid materials with a washing solution prepared from hard water in a washing area, which comprises in sequence:

(a) forming a charge of an aqueous washing solution having a dissolved content between 0.05 gm/liter and 3 gm/liter of a water-soluble calcium-binding sequestrant, and customary surface-active compounds selected from the group consisting of an anionic detergent and a nonionic detergent, (b) passing said washing solution through an area separate and spaced from the washing area, said separate area having a previously incorporated content of a water-insoluble cation-exchanging, bound-water containing crystalline aluminosilicate having a calcium binding power of at least 50 mg CaO/gm on the anhydrous basis and the formula $$(Cat_{2/n}O)_x.Al_2O_3.(SiO_2)_y$$

wherein Cat is a cation having the valence n which is exchangeable with calcium, x is a number from 0.7 to 1.5, and y is a number from 0.8 to 6, the amount of the aluminosilicate is from 0.2 gm to 10 gm per liter of washing solution, (c) separating said washing solution from said aluminosilicate, (d) washing said soiled material with said separated washing solution as washing medium, (e) pumping at least part of said washing medium through said separate area containing said aluminosilicate and recycling the separated washing solution as washing medium to said washing area, at such a rate that said washing medium passes a total of at least five times through said separate area containing said aluminosilicate during said washing step, and (f) continuing said recycling until said soiled solid material is substantially cleaned, the improvement consisting of employing an aluminosilicate having a particle size of from 0.05 to 1 mm, passing said washing solution through said separate area in Step (b) with a direction of flow opposite to the pull of gravity and selecting a flow velocity of said washing solution through said separate area wherein, at the outflow of said separate area, the flow velocity is less than the rate at which the aluminosilicate particles sink.

A further object of the present invention is the development of a simple and inexpensive apparatus to perform the above-described process, suitable for use in the home.

These and other objects of the present invention will become more apparent as the description thereof proceeds.

THE DRAWINGS

DESCRIPTION OF THE INVENTION

Figure 1:
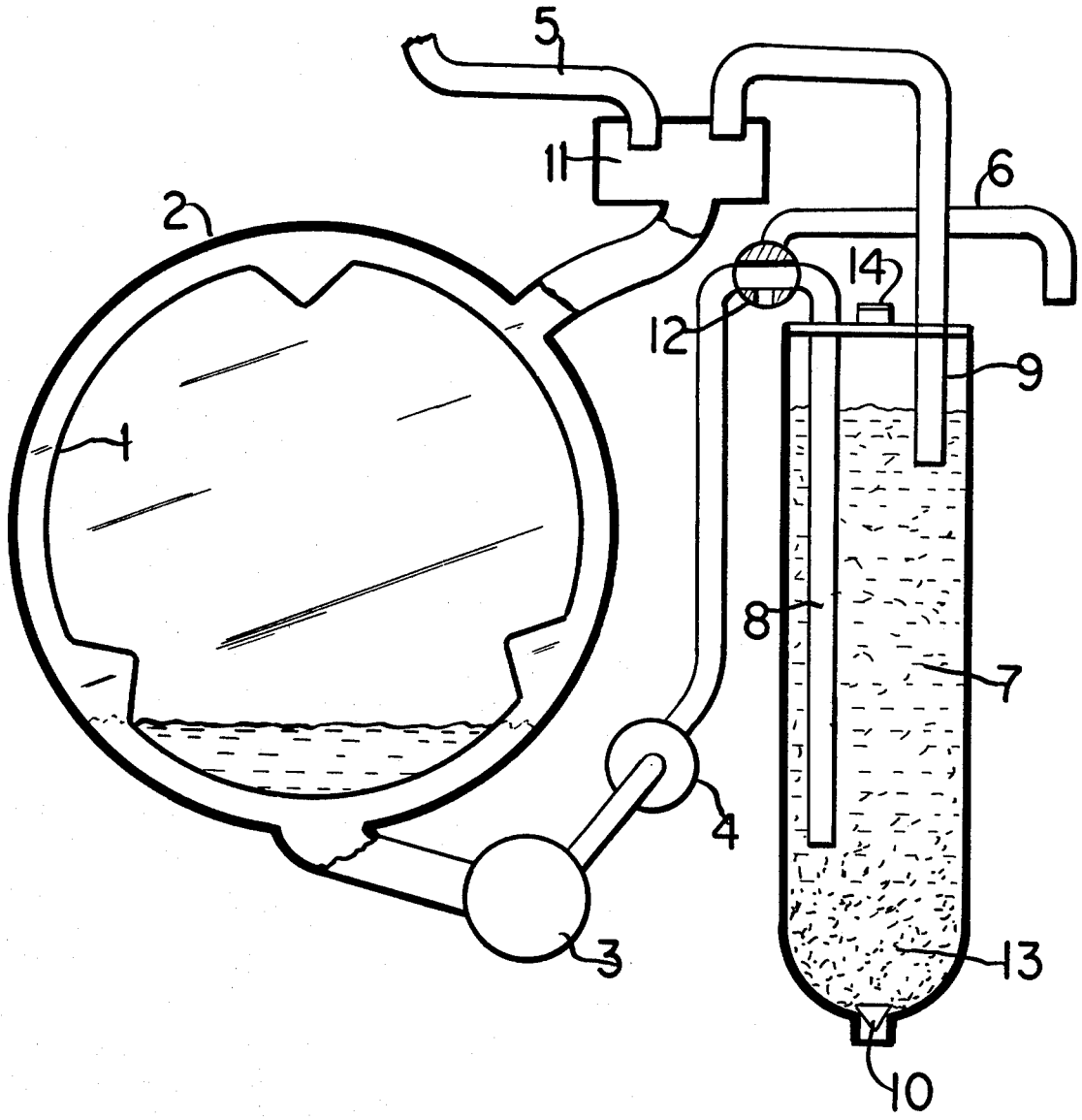
FIG. 1 is a schematic representation of one embodiment of the washing apparatus of the present invention showing a separate swirl chamber.

The present invention proposes a new method by which the problems described above can be solved and the objects of the invention can be achieved. It relates to a process for the machine washing and cleaning of solid materials, in particular textiles, using low phosphate or phosphate-free detergents, in which the detergent liquor, which contains at least 0.05 gm/l of a water-soluble, calcium-binding sequestrant, is continuously or intermittently circulated through a calcium-binding, water-insoluble, bound-water containing aluminosilicate corresponding to the following formula:

$$(Cat_{2/n}O)_x.Al_2O_3.(SiO_2)_y$$

in which Cat represents a cation of valence n which is exchangeable with calcium, x represents a number of from 0.7 to 1.5, and y represents a number of from 0.8 to 6, and in which the aluminosilicate has a particle size of from 0.05 to 1 mm and is situated in a swirl chamber connected into the circulation from the washing area back to the washing area, in which chamber the direction of flow opposes gravity and the velocity of flow of the liquid at the outflow is lower than the rate at which the aluminosilicate particles sink, wherein the solid aluminosilicate particles do not require filtration from the circulating washing medium.

More particularly, the present invention relates to the improvement in a cyclic method for the machine washing of soiled solid materials with a washing solution prepared from hard water in a washing area, which comprises in sequence:

(a) forming a charge of an aqueous washing solution having a dissolved content between 0.05 gm/liter and 3 gm/liter of a water-soluble calcium-binding sequestrant, and customary surface-active compounds selected from the group consisting of an anionic detergent and a nonionic detergent, (b) passing said washing solution through an area separate and spaced from the washing area, said separate area having a previously incorporated content of a water-insoluble cation-exchanging, bound-water containing crystalline aluminosilicate having a calcium binding power of at least 50 mg CaO/gm on the anhydrous basis and the formula $$(Cat_{2/n}O)_x.Al_2O_3.(SiO_2)_y$$

wherein Cat is a cation having the valence n which is exchangeable with calcium, x is a number from 0.7 to 1.5, and y is a number from 0.8 to 6, the amount of the aluminosilicate is from 0.2 gm to 10 gm per liter of washing solution, (c) separating said washing solution from said aluminosilicate, (d) washing said soiled material with said separated washing solution as washing medium, (e) pumping at least part of said washing medium through said separate area containing said aluminosilicate and recycling the separated washing solution as washing medium to said washing area, at such a rate that said washing medium passes a total of at least five times through said separate area containing said aluminosilicate during said washing step, and (f) continuing said recycling until said soiled solid material is substantially cleaned, the improvement consisting of employing an aluminosilicate having a particle size of from 0.05 to 1 mm, passing said washing solution through said separate area in Step (b) with a direction of flow opposite to the pull of gravity and selecting a flow velocity of said washing solution through said separate area wherein, at the outflow of said separate area, the flow velocity is less than the rate at which the aluminosilicate particles sink and wherein the solid aluminosilicate particles do not require filtration from the circulating washing medium.

Particularly suitable aluminosilicates are crystalline compounds corresponding to the given formula in which Cat represents sodium, x has a value of from 0.7 to 1.5, y has a value of from 1.3 to 3.3, and the calcium binding capacity is from 100 to 200 mg of CaO/gm of active anhydrous substance. The preparation and analysis of these aluminosilicates, as well as the determination of the calcium-binding power, has been described in detail in German Published Application (Auslegeschrift) No. 2,412,837, corresponding to U.S. patent application Ser. No. 458,309, filed Apr. 5, 1974, now abandoned in favor of its continuation Application Ser. No. 800,308, filed May 25, 1977, now abandoned in favor of its continuation-in-part Application Ser. No. 956,851, filed Nov. 2, 1978. A description of these aluminosilicates can also be found in U.S. Pat. No. 4,071,377.

The aluminosilicates obtained in this way generally have a very small particle size and must, therefore, be converted into coarser crystal aggregates or granulates of suitable particle diameter before they are used. This can be achieved by a method, not claimed as part of this invention, of modifying the crystallization phase or by granulating finely divided particles with inorganic or organic binders to give particles having a particle size of from 0.05 to 1 mm. It is preferred to use granulates having a particle size of from 0.1 to 0.5 mm. These have a satisfactory exchange capacity as well as a sufficient velocity of sinking.

The quantity of aluminosilicate required for a satisfactory washing or cleaning effect depends on its calcium binding capacity, the quantity and degree of soiling of the materials to be treated, and the hardness and quantity of the water used. The quantity of aluminosilicate used is preferably adjusted so that the residual hardness of the water is not greater than 6° dH (corresponding to 60 mg CaO per liter, preferably from 0.5° to 3° dH (from 5 to 30 mg CaO per liter).

In order to obtain an optimum washing and cleaning effect, it is advisable, especially in the case of heavily soiled substrates, to use a certain excess of aluminosilicates so that the calcium salts contained in the impurities which have been cleaned off will also be partly or completely bound. The quantities used for each cleaning operation would, therefore, be preferably in the region of from 0.2 to 10 gm, in particular from 1 to 6 gm of aluminosilicate per liter of wash liquor.

The washing or cleaning time depends on the degree of soiling, the rate of exchange and the rate of sinking of the aluminosilicates as well as on the output of the pumps. It may, therefore, vary within wide limits, for example, from five minutes to two hours, and is advantageously in the region of from 10 to 60 minutes. The output of the delivery system and the swirl chamber is preferably designed so that the wash liquor is pumped a total of at least ten times, preferably from 20 to 100 times, through the swirl chamber containing the aluminosilicate.

The output of the swirl chamber is restricted by the fact that the flow velocity of the detergent liquor must not exceed the rate of sinking of the aluminosilicate, to prevent that a substantial proportion of aluminosilicate is carried with the liquor into the cleaning vessel to the substrate which is to be cleaned. Since the particle size, and hence the velocity of sinking of the aluminosilicate particles cannot be increased indefinitely, it is advisable to provide a sufficiently large swirl chamber.

It is preferred to use swirl chambers having a larger cross-section in the region of the outlet opening than in the region of the inflow. The flow velocity is reduced in the region of larger cross-section, so that sinking of the aluminosilicate particles is promoted. At the same time, the reduction in cross-section in the region of the inflow increases the turbulence and hence promotes more rapid exchange of cations between the wash liquor and the cation exchange resin. The cross-sectional ratio between the inlet region and outlet region may be, for example, in the region of from 1:1.2 to 1:5.

In order that the aluminosilicate may be able to exert its full cleaning power even when spatially remote from the substrate to be cleaned, the presence of water-soluble complex formers which bind calcium ions or water-soluble, calcium-binding sequestrants is necessary. Suitable as sequestering agents for calcium for the purposes of the invention are also substances with such a low sequestering power that they were not considered heretofore as typical sequestering agents for calcium, but these compounds are frequently capable of delaying the precipitation of calcium carbonate from aqueous solutions. The sequestrants or precipitants binding calcium ions can be present in substoichiometric amounts, related to the hardness formers present. They act as "carriers," that is, their calcium salts are transformed into soluble salts by contact with the ion-exchanger and they are thus again available as sequestrants.

These complex formers may be provided in less than the stoichiometric quantity. Their proportion may be substantially lower than that required for complete sequestration of the alkaline earth and heavy metal ions present in the water and in the dirt, in particular the calcium ions.

The quantity of complex formers used is from 0.05 to 3 gm/l, preferably from 0.1 to 2 gm/l. Substantially larger quantities may, of course, be used, but if complex formers which contain phosphorus are used, the quantities should be such that the amount of phosphorus in the effluent is substantially lower than that found when using conventional detergents based on triphosphate for washing.

The sequestrants or precipitants comprise those of an inorganic nature like the water-soluble alkali metal (particularly the sodium) and ammonium pyrophosphates, triphosphates, higher polyphosphates, and metaphosphates.

Organic compounds which act as sequestrants or precipitants for calcium include the water-soluble polycarboxylic acids, hydroxycarboxy acids, aminocarboxy acids, carboxyalkyl ethers, polyanionic polymers and water-soluble salts thereof, particularly the polymeric carboxylic acids and the phosphonic acids, which are used as acids, alkali or aluminum salts and preferably as sodium salts.

Examples of polycarboxylic acids are dicarboxylic acids of the general formula:

$$HOOH—(CH_2)_n—COOH$$

wherein n=0 to 8, in addition maleic acid, methylenemalonic acid, citraconic acid, mesaconic acid, itaconic acid, noncyclic polycarboxylic acids with at least three carboxyl groups in the molecule, such as, for example, tricarballylic acid
aconitic acid
ethylene tetracarboxylic acid
1,1,3,3-propanetetracarboxylic acid
1,1,3,3,5,5-pentanehexacarboxylic acid
hexanehexacarboxylic acid
cyclic di- or polycarboxylic acids, such as, for example,
cyclopentanetetracarboxylic acid
cyclohexanehexacarboxylic acid
tetrahydrofurantetracarboxylic acid
phthalic acid
terephthalic acid
benzene-tricarboxylic acid
benzene-tetracarboxylic acid
benzene-pentacarboxylic acid,
as well as mellitic acid.

Examples of hydroxymonocarboxylic acids or hydroxy-polycarboxylic acids are glycolic acid, lactic acid, malic acid, tartronic acid, methyl tartronic acid, gluconic acid, glyceric acid, citric acid, tartaric acid, and salicylic acid.

Examples of aminocarboxylic acids are glycin, glycolglycin, alanin, asparagin, glutamic acid, aminobenzoic acid, iminodiacetic acid or iminotriacetic acid, (hydroxyethyl)-iminodiacetic acid, ethylenediaminetetraacetic acid, (hydroxyethyl)-ethylenediaminetriacetic acid, diethylenetriaminepentaacetic acid, as well as higher homologues, which can obtained by polymerization of an N-aziridylcarboxylic acid derivative, e.g., acetic acid, succinic acid, tricarballylic acid and subsequent saponification or by condensation of polyamines with a molecular weight of 500 to 10,000 with salts of chloroacetic or bromoacetic acid.

Examples of carboxyalkyl ethers are 2,2-oxydisuccinic acid and other ether polycarboxylic acids, particularly polycarboxylic acids containing carboxymethyl ether groups which comprise corresponding derivatives of the following polyvalent alcohols or hydroxycarboxylic acids, which can be completely or partly etherified with the glycolic acid:

glycol
diglycol
triglycol
glycerin
diglycerin
triglycerin
glycerin monomethyl ether
2,2-dihydroxymethyl-propanol
(1,1,1-trihydroxymethyl)-ethane
(1,1,1-trihydroxymethyl)-propane
erythrite
pentaerythrite
glycolic acid
lactic acid
tartronic acid
methyltartronic acid
glyceric acid
erythronic acid
malic acid
citric acid
tartaric acid
trihydroxy glutaric acid
saccharic acid
and mucic acid.

As transition types to the polymeric carboxylic acids, we mention the carboxymethyl ethers of sugar, starch and cellulose.

Among the polymeric carboxylic acids, the polymers of acrylic acid, hydroxyacrylic acid, maleic acid, itaconic acid, mesaconic acid, aconitic acid, methylene malonic acid, citraconic acid, etc., the copolymers of the above-mentioned carboxylic acids with each other or with ethylenically-unsaturated compounds, such as ethylene, propylene, isobutylene, vinyl alcohol, vinylmethyl ether, furan, acrolein, vinyl acetate, acrylamide, acrylonitrile, methacrylic acid, crotonic acid, etc., such as the 1:1 copolymers of maleic anhydride and ethylene or propylene or furan, play a special role.

Other polymeric carboxylic acids of the type of the polyhydroxypolycarboxylic acids or polyaldehydopolycarboxylic acids are substantially substances composed of acrylic acid and acrolein units or acrylic acid and vinyl alcohol units which can be obtained by copolymerization of acrylic acid and acrolein or by polymerization of acrolein and subsequent Cannizzaro reaction, if necessary, in the presence of formaldehyde.

Examples of phosphorus-containing organic sequestrants are alkane-polyphosphonic acid, amine- and hydroxyalkane polyphosphonic acids and phosphono-carboxylic acids, such as the compounds:

methane diphosphonic acid
propane-1,2,3-triphosphonic acid
butane-1,2,3,4-tetraphosphonic acid
polyvinyl phosphonic acid
1-amino-ethane-1,1-diphosphonic acid
1-amino-methane-1-phenyl-1,1-diphosphonic acid
aminotrimethylene-phosphonic acid
methylaminodimethylene-phosphonic acid
ethylaminodimethylene-phosphonic acid
ethylenediaminotetramethylene-phosphonic acid
1-hydroxyethane-1,1-diphosphonic acid
phosphonacetic acid
phosphonopropionic acid
1-phosphonoethane-1,2-dicarboxylic acid
2-phosphonopropane-2,3-dicarboxylic acid
2-phosphonobutane-1,2,4-tricarboxylic acid
2-phosphonobutane-2,3,4-tricarboxylic acid, as well as copolymers of vinyl phosphonic acid and acrylic acid.

The process of the present invention permits a reduction in the use of phosphorus-containing inorganic or organic sequestrants or precipitants to a content of inorganically or organically combined phosphorus in the treatment liquors of less than 0.6 gm/l, and preferably of less than 0.3 gm/l, or the working of the process completely without phosphorus-containing compounds.

The process of the present invention is usefully applied to waters of any given objectionable level of hardness.

Apart from washing textiles, which is the preferred field of application, the method and the device according to the invention are also suitable for any other cleaning operations where it is possible or of advantage to return or regenerate the cleaning solution. These applications comprise the cleaning of instruments, apparatus, pipe lines, boilers, and vessels of any material like glass, ceramic material, enamel, metal or plastic. An example is the industrial cleaning of bottles, drums and tank cars. The method is also particularly suitable for use in commercial or household dishwashing machines.

Depending on the use, customary surfactants, builder substances which increase the cleaning power, bleaching agents, as well as compounds which stabilize or activate such bleaching agents, graying inhibitors, optical brighteners, biocides or bacteriostatic substances, enzymes, foam inhibitors, corrosion inhibitors and substances regulating the pH value of the solution can be present in the washing and cleaning process. Such substances, which are normally present in varying amounts in the washing, rinsing and cleaning agents, are listed specifically in said patent application Ser. No. 458,306.

When using one or more of the above-mentioned substances which are generally present in cleaning liquors, the following concentrations are preferably maintained:

| Grams per liter | |
|---|---|
| 0 to 2.5 | Surfactants |
| 0.01 to 3 | Sequestrants |
| 0 to 3 | Other builder substances |
| to 0.4 | Active oxygen or equivalent amounts of active chlorine. |

The pH of the treatment liquors can range from 6 to 13, depending on the substrate to be washed or cleaned; preferably it is between 8.5 and 12.

The treatment temperature can vary within wide limits and is between 20° C. and 100° C. Since the washing and cleaning effect is already very high at low temperatures, that is, between 30° C. and 40° C., and exceeds that of conventional detergents and methods, it is possible to wash very delicate fabrics in this range, e.g., those of wool or silk or very fine procelain dishes with a very delicate overglaze or gold trim without damaging them.

The apparatus according to the invention for carrying out the process consists of a washing, cleaning or rinsing assembly of conventional or modified construction, a ring conduit equipped with circulating pump and at least one container for exchanger connected into the ring conduit, which container consists of a swirl chamber having an outlet for the circulated cleaning liquor situated near the top.

More particularly, the apparatus of the invention is essentially a mechanical washing apparatus comprising in combination:

(1) a tank adapted to contain the objects to be washed, (2) a conduit external to said tank, having a pump therein, adapted to circulate washing solution from one portion of said tank to another portion of said tank, (3) a vessel or swirl chamber in said conduit adapted to contain a water-insoluble cation-exchange agent having an average particle size of from 0.05 to 1 mm., (4) an inflow from said conduit to said vessel substantially at the bottom of said vessel and an outflow from said vessel to said conduit substantially at the top of said vessel, the size of said outflow being selected whereby the flow velocity of liquor being circulated by said pump at said outflow is less than the rate at which said cation-exchange agent particles sink and whereby the solid aluminosilicate particles do not require filtration from the circulating washing medium, and (5) separate means to introduce and withdraw water from said apparatus.

In a particularly advantageous embodiment of the apparatus, the inlet situated in the region of the base of the swirl chamber opens into a plurality of apertures arranged in branched form.

The apertures may be directly situated on the inlet pipe although the inlet preferably opens into a plurality of pipe elements branching from the central inlet pipe in stellate formation. These attached pipe elements may be straight or curved and may be arranged in a horizontal plane or at an angle thereto. Their length should be sufficient to bridge at least half the gap between the central inlet pipe and the internal wall of the swirl chamber. The upper limit of the number of the attached pipe elements, which should be at least two, is fixed only by considerations of space. From three to six pipe elements are in most cases sufficient.

The outlet apertures of the attached pipe elements may be situated radially, in which case the pipe elements are open at their ends. The cross-section of the outlet apertures may be equal to the cross-section of the pipes or they may be reduced, for example, by tapering the pipe elements at the end. It has been found advantageous to arrange the outlet apertures tangentially to the pipe elements so that a circular flow therefrom is obtained. The outlet apertures may be arranged so that the liquid leaves in a horizontal plane but they may also be arranged at an angle to the horizontal so that they also impart a downward or, better still, upward direction of flow. This angle may be, for example, up to 60° (to the horizontal). One or more apertures may be provided for each pipe element. Individual apertures may also point in different directions.

Finally, it may be advantageous if the branched pipe elements are rotatable as a unit in relation to the axis of inflow, on the principle of a Segners water wheel. The rotation of the branched pipe unit in stellate formation produced by the recoil adds to the swirling effect and any aluminosilicate particles which may have settled are vigorously mixed with the stream of liquid.

Some embodiments of the apparatus according to the invention are illustrated by way of example in the drawings.

FIG. 1 shows an arrangement in which a drum washing machine, represented schematically, is combined with a simply constructed swirl chamber. The parts of the washing machine which are conventional are the liquor tank 2 in which the washing drum 1 is rotatably mounted, the lint sieve 3 which is connected to the discharge pipe of the liquor tank and serves to hold back coarse impurities, the liquor pump 4, the fresh water supply 5, the discharge pipe 6 for spent washing liquor and the dispenser box for detergent 11. In the arrangement according to the invention, the pipe 8 extending from the liquor pump 4 passes through a two-way valve 12 to the lower part of the swirl chamber 7 which contains the aluminosilicate granulates 13 which may be introduced through the feed opening 14 and discharged through the discharge valve 10 after use. The spill pipe 9 for circulating washing liquor begins in the upper part of the swirl chamber 7 and leads to the dispenser box 11, whence the washing liquor flows back into the liquor tank.

Figure 2:
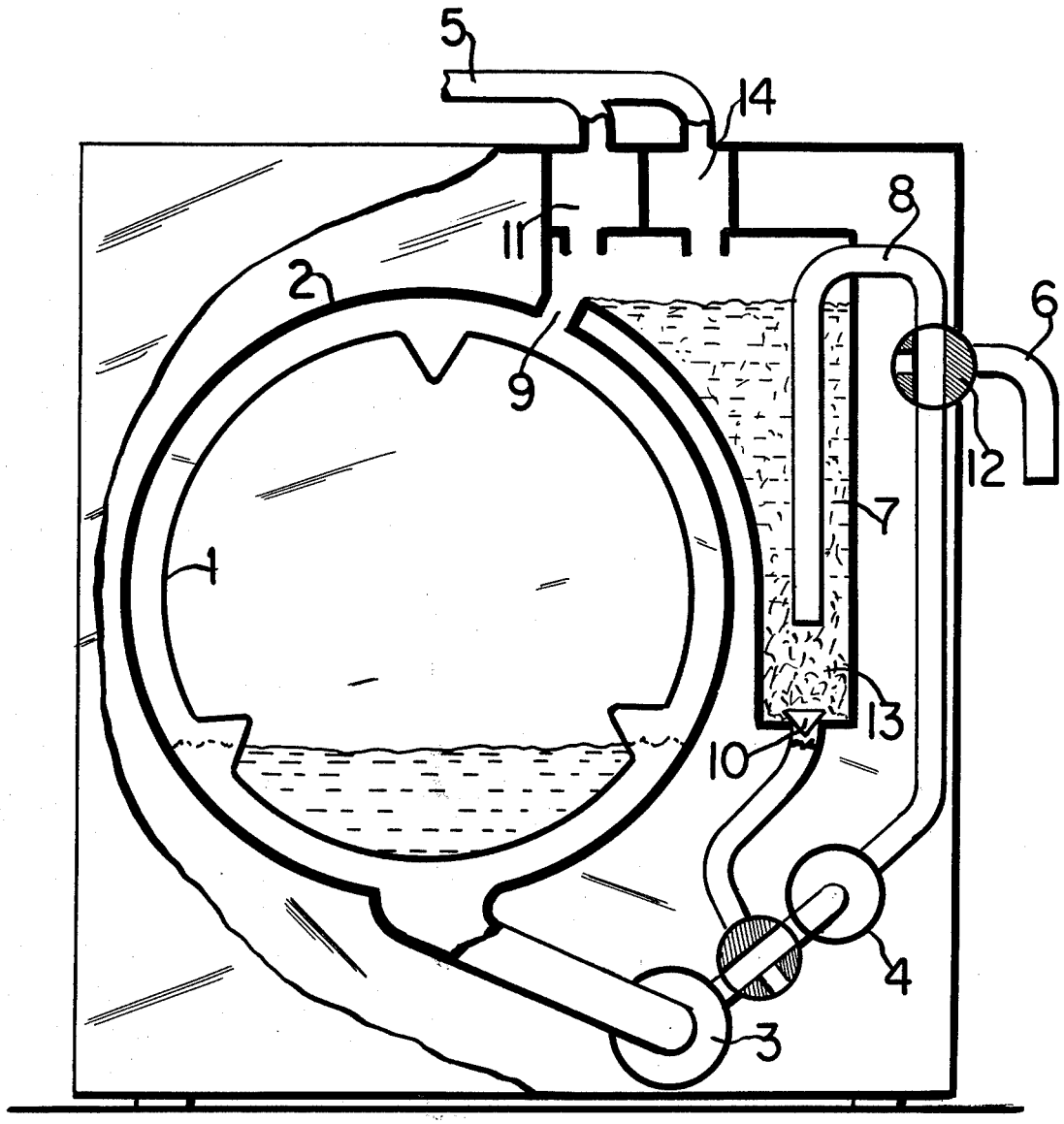
FIG. 2 is a schematic representation of another embodiment of the separate swirl chamber of the present invention.

FIG. 2 shows an arrangement which is completely integrated into the casing 19 of a drum washing machine. The reference numerals have the same meaning as in FIG. 1. The swirl chamber 7 fits snugly to the liquor drum 2 so that its cross-section increases towards the top to form an extended zone of pacification for the granulates. Such an arrangement at the same time has the advantage of reduced heat loss by radiation and takes up very little space. The overflow pipe 9 from the swirl chamber to the liquor drum also serves to supply the detergent stored in the dispenser box 11 during the washing-in phase. Part of the water used for washing in the detergent can be directed into the metering device 14 for aluminosilicate, from where it is transferred to the swirl chamber 7. Spent aluminosilicate 13 is discharged through the liquor pump 4 and discharge pipe 6 after opening of the outlet valve 10.

Figure 3:
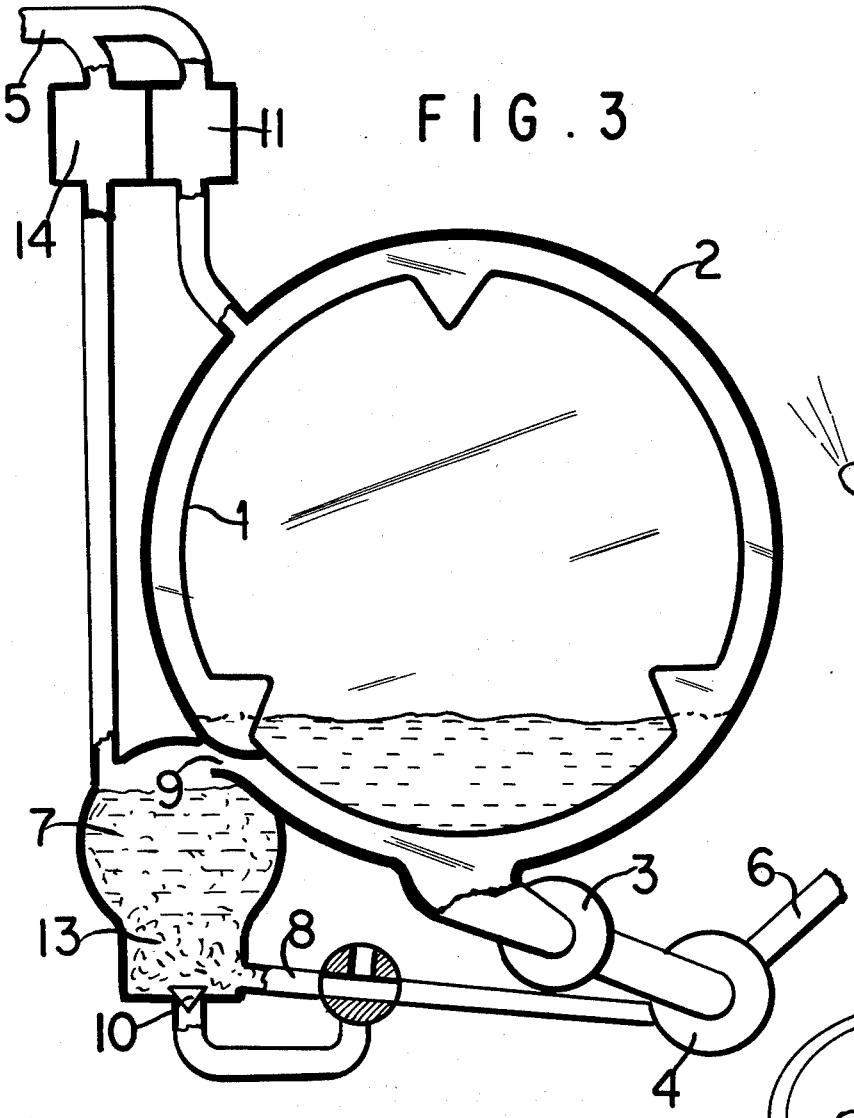
FIG. 3 is a schematic representation of still another embodiment of the separate swirl chamber of the present invention.

FIG. 3 shows another embodiment, in which the cross-section of the swirl chamber 7 again increases at the top. The inlet 8 enters the swirl chamber at the bottom of the side while the overflow 9 is integrated with the liquor drum 2. Aluminosilicate is fed in by way of the metering chamber 14 from which it is transferred to the swirl chamber 7 together with part of the washing-in water. It is discharged through the outlet pipe 6 by way of the valve 10 and pump 4.

Figure 4:
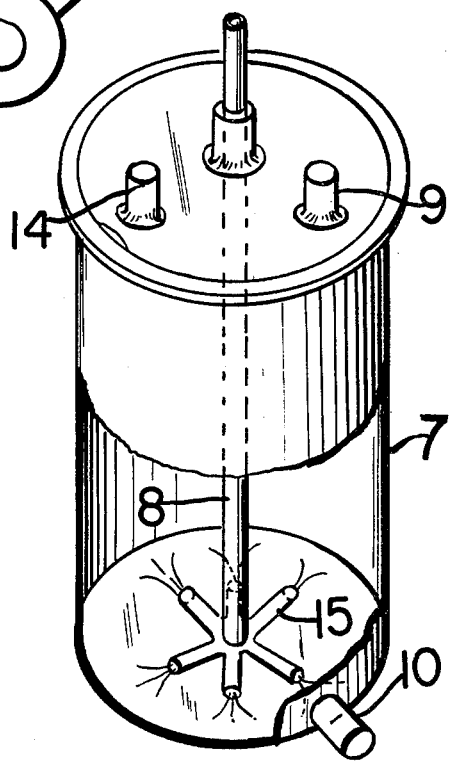
FIG. 4 is a schematic representation of one embodiment for insertion of the washing solution into the separate swirl chamber of the present invention.

FIG. 4 shows the arrangement of the inflow 8 and stellate pipe unit 15 inside the swirl chamber 7. The pipe connection 14 is provided for the supply and the pipe connection 10 for the removal of aluminosilicate. The washing liquor arriving through 8 flows out at the ends of the stellate pipe unit 15 as indicated by the arrows and leaves the swirl chamber through the pipe connection(s) 9.

Figure 5:
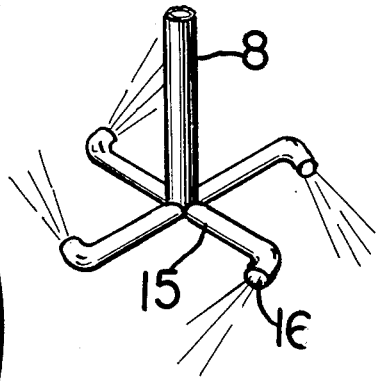
FIG. 5 is a plane view of a separate swirl chamber inlet nozzle arrangement.

FIG. 5 shows an outflow device with tangentially arranged outflow aperatures 16.

Figure 6:
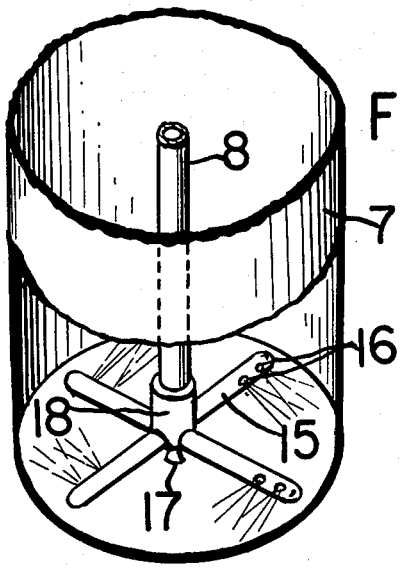
FIG. 6 is a schematic representation of a rotating nozzle arrangement for the separate swirl chamber inlet of the present invention.

In FIG. 6, the outflow aperture is rotatable in relation to the inflow 8. It rests on a mounting 17 at the base of the swirl chamber 7 and is supported by a second mounting 18, which may, for example, be made of plastic. The pipe elements 15 are closed at their ends. The liquid leaves through one or more lateral openings and rotates the tubular cross pipes by recoil.

The invention is not limited to the arrangements illustrated.

The process and apparatus according to the invention have the advantage over those in which a filter is used for separating the granular aluminosilicate in that trouble due to blocked filters is eliminated. Furthermore, the preferred embodiment, in which the outflow apertures are arranged in stellate formation, effects very intensive and uniform swirling up of the aluminosilicate granulates in the chamber so that rapid exchange of cations between the wash liquor and aluminosilicate is ensured. Due to the direction of flow established, no part of the aluminosilicate is carried away and transferred to the material to be cleaned.

The following examples are illustrative of the invention without being limitative in any respect.

EXAMPLES

An arrangement consisting of a program controlled drum washing machine and cylindrical swirl chamber according to FIGS. 1 and 4 was used. The sodium aluminosilicate used had a particle size of from 0.1 to 0.5 mm and a calcium binding capacity of 150 mg of CaO per gram of active anhydrous substance. The washing liquor contained the following substances:

| Grams per Liter | |
|---|---|
| 0.5 | Na n-dodecylbenzene sulfonate |
| 0.17 | Tallow alcohol, ethoxylated (14 mols of ethylene oxide) |
| 0.27 | Na soap (tallow soap:behenate soap 1:1) |
| 0.015 | Na ethylenediaminetetraacetate (EDTA) |

-continued

| Grams per Liter | |
|---|---|
| 0.25 | Na silicate ($Na_2:SiO_2$ = 1:3.3) |
| 0.11 | Na carboxymethyl cellulose (Na-CMC) |
| 2.0 | Sodium perborate tetrahydrate |
| 0.15 | Magnesium silicate |
| 0.2 | Sodium sulfate |

The following additives were used, either introduced into the washing liquor, if water soluble, or into the swirl chamber 7:

| | Grams per Liter | |
|---|---|---|
| (a) | 3.5 | Na tripolyphosphate (TPP) |
| (b) | | No further additives |
| (c) | 0.4 | TPP |
| (d) | 0.4 | TPP |
| | 0.4 | Na citrate |
| (e) | 8.0 | Aluminosilicate |
| | 0.2 | Na nitrilotriacetate (NTA) |
| (f) | 8.0 | Aluminosilicate |
| | 0.4 | TPP |
| (g) | 8.0 | Aluminosilicate |
| | 0.4 | TPP |
| | 0.4 | Na citrate |

Formulation (a) is that of a conventional powerful detergent with a high phosphate content.

The washing machine was loaded with 3 kg of clean washing to fill it and two textile samples (20×20 cm) each of cotton (C), finished cotton (FC), and a mixed fabric of 50% polyester and 50% finished cotton (P.FC). The textile samples had been artificially soiled with skin grease, kaolin, iron oxide black and soot. The hardness of the tap water was 16° dH (160 mg CaO/l). The quantity of washing liquor was 20 liters and the washing time was 45 minutes at 90° C., including a heating-up period of 30 minutes. The output of the pump was adjusted to circulate 8 liters of washing liquor per minute. At this rate, the aluminosilicate in the swirl chamber was kept in vigorous motion without the particles reaching the outflow aperture. At the end of the washing process, the textiles were rinsed four times with clear water and then spun and dried.

The percentage reflectance of the textile samples was determined photometrically. The results are summarized in the following Table. The abbreviation "P" represents phosphate.

TABLE

| Formulation | Characteristics | Reflectance C | FC | P.FC |
|---|---|---|---|---|
| a | Comparison, high-P | 79 | 70 | 67 |
| b | Comparison, P-free | 57 | 57 | 52 |
| c | Comparison, low-P | 55 | 57 | 52 |
| d | Comparison, low-P | 57 | 58 | 54 |
| e | Example 1, P-free | 79 | 70 | 63 |
| f | Example 2, low-P | 78 | 71 | 64 |
| g | Example 3, low-P | 79 | 72 | 66 |

The results show that the washing effect of detergents with a high phosphate content is attained or exceeded by the process of the invention with little if any phosphate (Formulations e, f and g).

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. In a cyclic method for the machine washing of soiled solid materials with a washing solution prepared from hard water in a washing area, which comprises in sequence:

(a) forming a charge of an aqueous washing solution having a dissolved content between 0.05 gm/liter and 3 gm/liter of a water-soluble calcium-binding sequestrant, and customary surface-active compounds selected from the group consisting of an anionic detergent and a nonionic detergent, (b) passing said washing solution through an area separate and spaced from the washing area, said separate area having a previously incorporated content of a water-insoluble cation-exchanging, bound-water-containing crystalline aluminosilicate having a calcium-binding power of at least 50 mg CaO/gm on the anhydrous basis and the formula $$(Cat_{2/n}O)_x.Al_2O_3.(SiO_2)_y$$

wherein Cat is a cation having the valence n which is exchangeable with calcium, x is a number from 0.7 to 1.5, and y is a number from 0.8 to 6, the amount of the aluminosilicate is from 0.2 gm to 10 gm per liter of washing solution, (c) separating said washing solution from said aluminosilicate, (d) pumping at least part of said washing medium through said separate area containing said aluminosilicate and recycling the separated washing solution as washing medium to said washing area, at such a rate that said washing medium passes a total of at least five times through said separate area containing said aluminosilicate during said washing step, and (e) continuing said recycling until said soiled solid material is substantially cleaned, the improvement consisting of employing an aluminosilicate having a particle size of from 0.05 to 1 mm, passing said washing solution through said separate area in Step (b) with a direction of flow opposite to the pull of gravity, and selecting a flow velocity of said washing solution through said separate area wherein, at the outflow of said separate area, the flow velocity is less than the rate at which the aluminosilicate particles sink, wherein the solid aluminosilicate particles do not require filtration from the circulating washing medium.

2. The process of claim 1 wherein said soiled solid materials are soiled textiles.

3. The process of claim 1 wherein, in the general formula of the crystalline aluminosilicate, Cat represents Na, x is from 0.7 to 1.5 and y is from 1.3 to 3.3.

4. The process of claim 1 wherein said aluminosilicate has a particle size of from 0.1 to 0.5 mm.

5. The process of claim 1 wherein said washing medium passes through said separate area, of Step (d) at least ten times.

6. The process of claim 1 wherein said washing medium passes through said separate area, of Step (d) from 20 to 100 times.

7. The process of claim 1 wherein said separate area containing said aluminosilicate has a larger cross-section in the region of the outflow than in the region of the inflow.

8. The process of claim 1 wherein the inflow in said separate area in a direction of flow opposite to the pull of gravity causes a swirling of said aluminosilicate particles.

* * * * *

UNITED STATES PATENT AND TRADEMARK OFFICE

CERTIFICATE OF CORRECTION

PATENT NO. : 4,221,565

DATED : September 9, 1980

INVENTOR(S) : WERNER GRAUPNER ET AL.

It is certified that error appears in the above—identified patent and that said Letters Patent is hereby corrected as shown below:

Preamble page: The following insertion should be made:

"[30] Foreign Application Priority Data

| | | |
|---|---|---|
| Dec. 29, 1977 | Fed. Rep. of Germany | 2758685 |
| May 2, 1978 | Fed. Rep. of Germany | 2819233 " |

Column 8, line 21: "to 0.4" should read -- 0 to 0.4 --.

Signed and Sealed this

*Fifteenth* Day of *September 1981*

[SEAL]

*Attest:*

GERALD J. MOSSINGHOFF

*Attesting Officer*

*Commissioner of Patents and Trademarks*